US006789059B2

(12) United States Patent
Kandhadai et al.

(10) Patent No.: US 6,789,059 B2
(45) Date of Patent: Sep. 7, 2004

(54) REDUCING MEMORY REQUIREMENTS OF A CODEBOOK VECTOR SEARCH

(75) Inventors: Ananthapadmanabhan Kandhadai, San Diego, CA (US); Andrew P. DeJaco, San Diego, CA (US); Sharath Manjunath, Bangalore (IN)

(73) Assignee: Qualcomm Incorporated, San Diego, CA (US)

( * ) Notice: Subject to any disclaimer, the term of this patent is extended or adjusted under 35 U.S.C. 154(b) by 227 days.

(21) Appl. No.: 09/876,352

(22) Filed: Jun. 6, 2001

(65) Prior Publication Data

US 2003/0046066 A1 Mar. 6, 2003

(51) Int. Cl.[7] ..... G10L 19/10
(52) U.S. Cl. ..... 704/216; 704/221
(58) Field of Search ..... 704/212, 216, 704/217, 218, 221, 222, 223

(56) References Cited

U.S. PATENT DOCUMENTS

| | | | | |
|---|---|---|---|---|
| 4,901,307 A | | 2/1990 | Gilhousen et al. | |
| 4,962,536 A | | 10/1990 | Satoh | |
| 5,109,390 A | | 4/1992 | Gilhousen et al. | |
| 5,265,190 A | * | 11/1993 | Yip et al. | 704/219 |
| 5,327,519 A | * | 7/1994 | Haggvist et al. | 704/219 |
| 5,414,796 A | | 5/1995 | Jacobs et al. | |
| 5,444,816 A | | 8/1995 | Adoul et al. | |
| 5,485,581 A | * | 1/1996 | Miyano et al. | 704/223 |
| 5,751,901 A | * | 5/1998 | DeJaco et al. | 704/216 |
| 5,924,062 A | * | 7/1999 | Maung | 704/219 |
| 6,067,515 A | * | 5/2000 | Cong et al. | 704/243 |
| 6,219,642 B1 | * | 4/2001 | Asghar et al. | 704/256 |
| 6,347,297 B1 | * | 2/2002 | Asghar et al. | 704/243 |
| 6,424,941 B1 | * | 7/2002 | Yu | 704/221 |
| 6,714,907 B2 | * | 3/2004 | Gao | 704/220 |

FOREIGN PATENT DOCUMENTS

EP 0658877 6/1995

OTHER PUBLICATIONS

J–P. Adoul, et al. "Fast CELP coding based on algebraic codes," Communication Research Center, University of Sherbrooke, Sherbrooke, P.Q., Canada, J1K2R1. IEEE 1987 (pp. 1957–1960).

U.S. patent application Publication No. 2001/0014856 A1; Published Aug. 16, 2001 to Wuppermann, et al.

* cited by examiner

*Primary Examiner*—Richemond Dorvil
*Assistant Examiner*—Martin Lerner
(74) *Attorney, Agent, or Firm*—Philip Wadsworth; Charles D. Brown; Kyong H. Macek

(57) ABSTRACT

Methods and apparatus for quickly selecting an optimal excitation waveform from a codebook are presented herein. To reduce the number of computations required to choose the optimal codebook vector, a subset of codevectors are selected based upon optimal pulse locations, wherein the subset of codevectors form a subcodebook. Rather than searching the entire codebook, only the entries of the subcodebook are searched.

4 Claims, 5 Drawing Sheets

REDUCING MEMORY REQUIREMENTS OF A CODEBOOK VECTOR SEARCH

BACKGROUND

1. Field

The present invention relates generally to communication systems, and more particularly, to speech processing within communication systems.

2. Background

The field of wireless communications has many applications including, e.g., cordless telephones, paging, wireless local loops, personal digital assistants (PDAs), Internet telephony, and satellite communication systems. A particularly important application is cellular telephone systems for mobile subscribers. As used herein, the term "cellular" system encompasses both cellular and personal communications services (PCS) frequencies. Various over-the-air interfaces have been developed for such cellular telephone systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile (GSM), and Interim Standard 95 (IS-95). In particular, IS-95 and its derivatives, IS-95A, IS-95B, ANSI J-STD-008 (often referred to collectively herein as IS-95), and proposed high-data-rate systems for data, etc. are promulgated by the Telecommunication Industry Association (TIA) and other well known standards bodies.

Cellular telephone systems configured in accordance with the use of the IS-95 standard employ CDMA signal processing techniques to provide highly efficient and robust cellular telephone service. Exemplary cellular telephone systems configured substantially in accordance with the use of the IS-95 standard are described in U.S. Pat. Nos. 5,103,459 and 4,901,307which are assigned to the assignee of the present invention and incorporated by reference herein. An exemplary system utilizing CDMA techniques is the cdma2000 ITU-R Radio Transmission Technology (RTT) Candidate Submission (referred to herein as cdma2000), issued by the TIA. The standard for cdma2000 is given in the draft versions of IS-2000 and has been approved by the TIA. The cdma2000 proposal is compatible with IS-95 systems in many ways. Another CDMA standard is the W-CDMA standard, as embodied in 3rd *Generation Partnership Project "3GPP"*, Document Nos. 3G TS 25.211, 3G TS 25.212, 3G TS 25.213and 3G TS 25.214.

With the proliferation of digital communication systems, the demand for efficient frequency usage is constant. One method for increasing the efficiency of a system is to transmit compressed signals. In a regular landline telephone system, a sampling rate of 64 kilobits per second (kbps) is used to recreate the quality of an analog voice signal in a digital transmission. However, by using compression techniques that exploit the redundancies of a voice signal, the amount of information that is transmitted over-the-air can be reduced while still maintaining a high quality.

Typically, conversion of an analog voice signal to a digital signal is performed by an encoder and conversion of the digital signal back to a voice signal is performed by a decoder. In an exemplary CDMA system, a vocoder comprising both an encoding portion and a decoding portion is located within remote stations and base stations. An exemplary vocoder is described in U.S. Pat. No. 5,414,796, entitled "Variable Rate Vocoder," assigned to the assignee of the present invention and incorporated by reference herein. In a vocoder, an encoding portion extracts parameters that relate to a model of human speech generation. A decoding portion re-synthesizes the speech using the parameters received over a transmission channel. The model is constantly changing to accurately model the time varying speech signal. Thus, the speech is divided into blocks of time, or analysis frames, during which the parameters are calculated. The parameters are then updated for each new frame. As used herein, the word "decoder" refers to any device or any portion of a device that can be used to convert digital signals that have been received over a transmission medium. The word "encoder" refers to any device or any portion of a device that can be used to convert acoustic signals into digital signals. Hence, the embodiments described herein can be implemented with vocoders of CDMA systems, or alternatively, encoders and decoders of non-CDMA systems.

Of the various classes of speech coder, the Code Excited Linear Predictive Coding (CELP), Stochastic Coding, or Vector Excited Speech Coding coders are of one class. An example of a coding algorithm of this particular class is described in Interim Standard 127 (IS-127), entitled, "Enhanced Variable Rate Coder" (EVRC). Another example of a coder of this particular class is described in pending draft proposal "Selectable Mode Vocoder Service Option for Wideband Spread Spectrum Communication Systems," Document No. 3GPP2 C.P9001. The function of the vocoder is to compress the digitized speech signal into a low bit rate signal by removing all of the natural redundancies inherent in speech. In a CELP coder, redundancies are removed by means of a short-term formant (or LPC) filter. Once these redundancies are removed, the resulting residual signal can be modeled as white Gaussian noise, or a white periodic signal, which also must be coded. Hence, through the use of speech analysis, followed by the appropriate coding, transmission, and re-synthesis at the receiver, a significant reduction in the data rate can be achieved.

The coding parameters for a given frame of speech are determined by first determining the coefficients of a linear prediction coding (LPC) filter. The appropriate choice of coefficients will remove the short-term redundancies of the speech signal in the frame. Long-term periodic redundancies in the speech signal are removed by determining the pitch lag, L, and pitch gain, $g_p$, of the signal. The combination of possible pitch lag values and pitch gain values is stored as vectors in an adaptive codebook. An excitation signal is then chosen from among a number of waveforms stored in an excitation waveform codebook. When the appropriate excitation signal is excited by a given pitch lag and pitch gain and is then input into the LPC filter, a close approximation to the original speech signal can be produced. Thus, a compressed speech transmission can be performed by transmitting LPC filter coefficients, an identification of the adaptive codebook vector, and an identification of the fixed codebook excitation vector.

An effective excitation codebook structure is referred to as an algebraic codebook. The actual structure of algebraic codebooks is well known in the art and is described in the paper "Fast CELP coding based on Algebraic Codes" by J. P. Adoul, et al., Proceeedings of ICASSP Apr. 6–9, 1987. The use of algebraic codes is further disclosed in U.S. Pat. No. 5,444,816 entitled "Dynamic Codebook for Efficient Speech Coding Based on Algebraic Codes", the disclosure of which is incorporated by references.

Due to the intensive computational and storage requirements of implementing codebook searches for optimal excitation vectors, there is a constant need to reduce the storage requirements involved in conducting a codebook search.

SUMMARY

Novel methods and apparatus for implementing a fast code vector search in coders are presented. In one aspect, a method is presented for reducing the memory requirements needed to conduct a search for a vector in a codebook.

In another aspect, an apparatus for selecting an optimal pulse vector from a pulse vector codebook is presented, wherein the optimal pulse vector is used by a linear prediction coder to encode a residual waveform. The apparatus comprises: an impulse response generator for generating an impulse response vector; a cross-correlation element configured to determine a cross-correlation vector relating the impulse response vector to a plurality of target signal samples from a filter, wherein the cross-correlation vector is used to determine a plurality of pulse positions such that the insertion of the plurality of pulse positions into the cross-correlation vector provides a predetermined number of high cross-correlation values; a pulse codebook generator configured to receive an indication signal indicative of the plurality of pulse positions from the cross-correlation element, and to output a plurality of pulse vectors in response to the indication signal, wherein the plurality of pulse vectors is a subset of the pulse vector codebook; and an energy computation element for determining an autocorrelation sub-matrix based upon the subset of the pulse vector codebook, wherein the autocorrelation sub-matrix and the cross-correlation vector are used to select the optimal pulse vector from the codebook.

In another aspect, an apparatus for reducing the memory requirements of a codebook search is presented. The apparatus comprises: an impulse response generator for generating an impulse response signal; a cross-correlation element configured to determine a cross-correlation vector relating the impulse response signal to a target signal; a selection element configured to receive the cross-correlation vector, to use the cross-correlation vector to identify an optimal set of a pulse positions, and to generate an indication signal that carries the identification of the optimal set of pulse positions; a pulse codebook generator that is configured to receive the indication signal from the selection element and to generate a plurality of pulse vectors, wherein the plurality of pulse vectors are generated based upon the identification of the optimal set of pulse positions carried by indication signal; and an energy computation element for determining an autocorrelation sub-matrix based on the plurality of pulse vectors, wherein the autocorrelation sub-matrix is used instead of an autocorrelation matrix, thereby decreasing the memory requirement of the codebook search.

In another aspect, a method for selecting an optimal pulse vector from a codebook is presented. The method comprises: determining a cross-correlation vector between a target signal and an impulse response, wherein each component in the cross-correlation vector corresponds to a position in an analysis frame; determining a plurality of P positions that correspond to the P largest components of the cross-correlation vector; selecting a plurality of pulse vectors from the codebook to form a subcodebook, wherein each of the plurality of pulse vectors correspond to at least one of the plurality of P positions; determining an autocorrelation matrix based on the plurality of P pulse vectors; and selecting the optimal pulse vector from the plurality of P pulse vectors.

In another aspect, method for reducing the computational complexity of a codebook search is presented. The method comprises: determining an energy value matrix using a partial set of autocorrelation values; storing the energy value matrix; using the energy value matrix and a cross-correlation value from a plurality of cross-correlation values to determine a criterion value for each vector in a plurality of vectors, wherein each cross-correlation value describes a relationship between a target signal and a respective vector in the codebook; and selecting a vector as optimal if the vector has the highest criterion ratio value.

DETAILED DESCRIPTION

Figure 1:
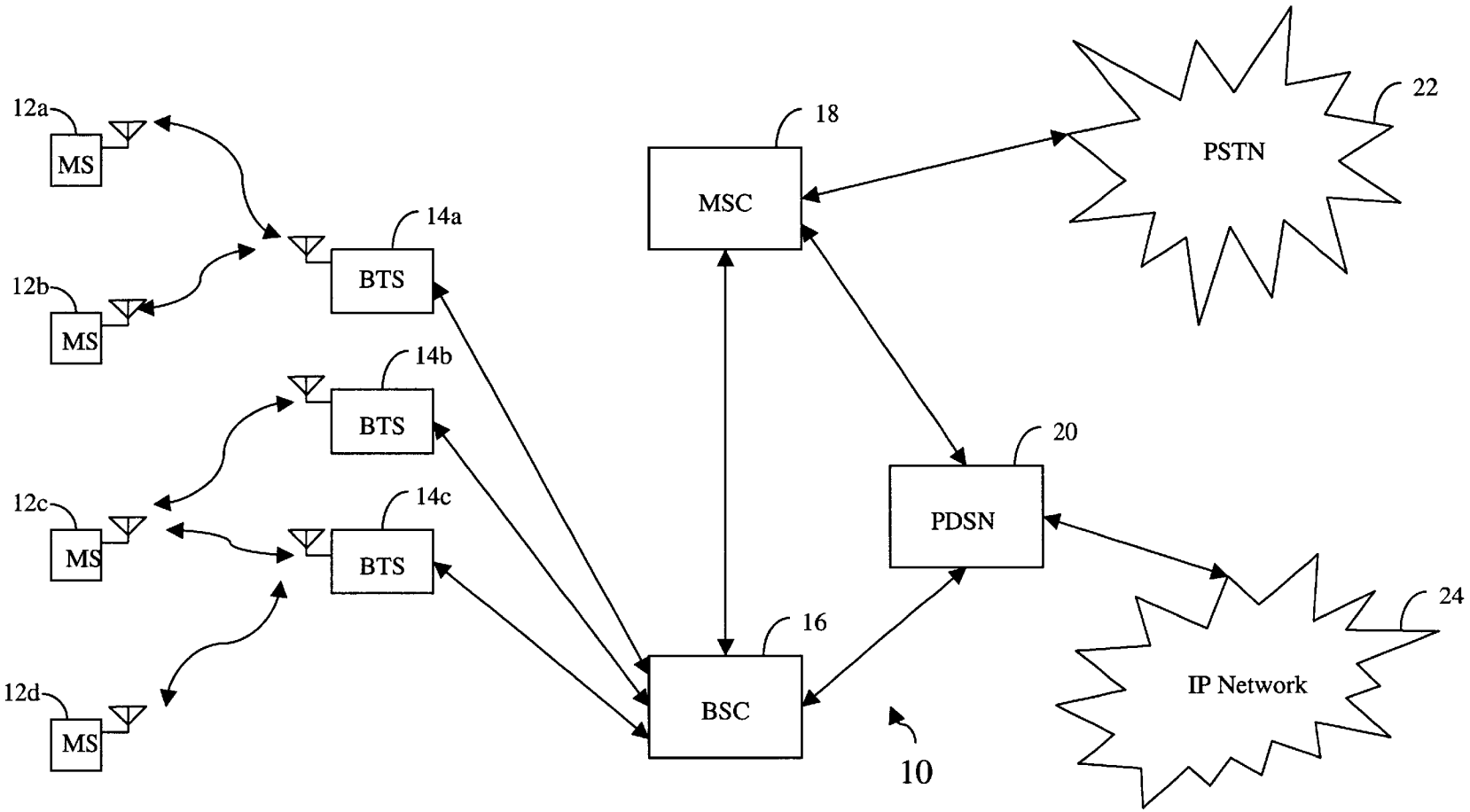
FIG. 1 is a block diagram of an exemplary communication system.

As illustrated in FIG. 1, a wireless communication network 10 generally includes a plurality of remote stations (also called mobile stations or subscriber units or user equipment) 12*a*–12*d*, a plurality of base stations (also called base station transceivers (BTSs) or Node B) 14*a*–14*c*, a base station controller (BSC) (also called radio network controller or packet control function 16), a mobile switching center (MSC) or switch 18, a packet data serving node (PDSN) or internetworking function (IWF) 20, a public switched telephone network (PSTN) 22 (typically a telephone company), and an Internet Protocol (IP) network 24 (typically the Internet). For purposes of simplicity, four remote stations 12*a*–12*d*, three base stations 14*a*–14*c*, one BSC 16, one MSC 18, and one PDSN 20 are shown. It would be understood by those skilled in the art that there could be any number of remote stations 12, base stations 14, BSCs 16, MSCs 18, and PDSNs 20.

In one embodiment the wireless communication network 10 is a packet data services network. The remote stations 12*a*–12*d* may be any of a number of different types of wireless communication device such as a portable phone, a cellular telephone that is connected to a laptop computer running IP-based, Web-browser applications, a cellular telephone with associated hands-free car kits, a personal data assistant (PDA) running IP-based, Web-browser applications, a wireless communication module incorporated into a portable computer, or a fixed location communication module such as might be found in a wireless local loop or meter reading system. In the most general embodiment, remote stations may be any type of communication unit.

The remote stations 12*a*–12*d* may be configured to perform one or more wireless packet data protocols such as described in, for example, the EIA/TIA/IS-707 standard. In a particular embodiment, the remote stations 12a–12d generate IP packets destined for the IP network 24 and encapsulate the IP packets into frames using a point-to-point protocol (PPP).

In one embodiment, the IP network 24 is coupled to the PDSN 20, the PDSN 20 is coupled to the MSC 18, the MSC 18 is coupled to the BSC 16 and the PSTN 22, and the BSC 16 is coupled to the base stations 14a–14c via wirelines configured for transmission of voice and/or data packets in accordance with any of several known protocols including, e.g., E1 T1 Asynchronous Transfer Mode (ATM), IP, Frame Relay, HDSL, ADSL, or xDSL. In an alternate embodiment, the BSC 16 is coupled directly to the PDSN 20, and the MSC 18 is not coupled to the PDSN 20. In another embodiment, the remote stations 12a–12d communicate with the base stations 14a–14c over an RF interface defined in the 3rd *Generation Partnership Project* 2 "3 *GPP*2", "Physical Layer Standard for cdma 2000 Spread Spectrum Systems," 3GPP2 Document No. C.P0002-A, TIA PN-4694to be published as TIA/EIA/IS-2000-2-A, (Draft, edit version 30) (Nov. 19, 1999), which is fully incorporated herein by reference. In another embodiment, the remote stations 12a–12d communicate with the base stations 14a–14c over an RF interface defined in 3rd *Generation Partnership Project* "3*GPP*", Document Nos. 3G TS 25.211, 3G TS 25.212, 3G TS 25.213and 3G TS 25.214.

During typical operation of the wireless communication network 10, the base stations 14a–14c receive and demodulate sets of reverse-link signals from various remote stations 12a–12d engaged in telephone calls, Web browsing, or other data communications. Each reverse-link signal received by a given base station 14a–14c is processed within that base station 14a–14c. Each base station 14a–14c may communicate with a plurality of remote stations 12a–12d by modulating and transmitting sets of forward-link signals to the remote stations 12a–12d. For example, as shown in FIG. 1, the base station 14a communicates with first and second remote stations 12a, 12b simultaneously, and the base station 14c communicates with third and fourth remote stations 12c, 12d simultaneously. The resulting packets are forwarded to the BSC 16, which provides call resource allocation and mobility management functionality including the orchestration of soft handoffs of a call for a particular remote station 12a–12d from one base station 14a–14c to another base station 14a–14c. For example, a remote station 12c is communicating with two base stations 14b, 14c simultaneously. Eventually, when the remote station 12c moves far enough away from one of the base stations 14c the call will be handed off to the other base station 14b.

If the transmission is a conventional telephone call, the BSC 16 will route the received data to the MSC 18, which provides additional routing services for interface with the PSTN 22. If the transmission is a packet-based transmission, such as a data call destined for the IP network 24, the MSC 18 will route the data packets to the PDSN 20, which will send the packets to the IP network 24. Alternatively, the BSC 16 will route the packets directly to the PDSN 20, which sends the packets to the IP network 24.

As discussed above, a speech signal can be segmented into frames, and then modeled by the use of LPC filter coefficients, adaptive codebook vectors, and fixed codebook vectors. In order to create an optimal model of the speech signal, the difference between the actual speech and the recreated speech must be minimal. One technique for determining whether the difference is minimal is to determine the correlation values between the actual speech and the recreated speech and to then choose a set of components with a maximum correlation property.

Reducing Storage Requirements of a Coder That Does Not Use Pitch Enhancements

Figure 2:
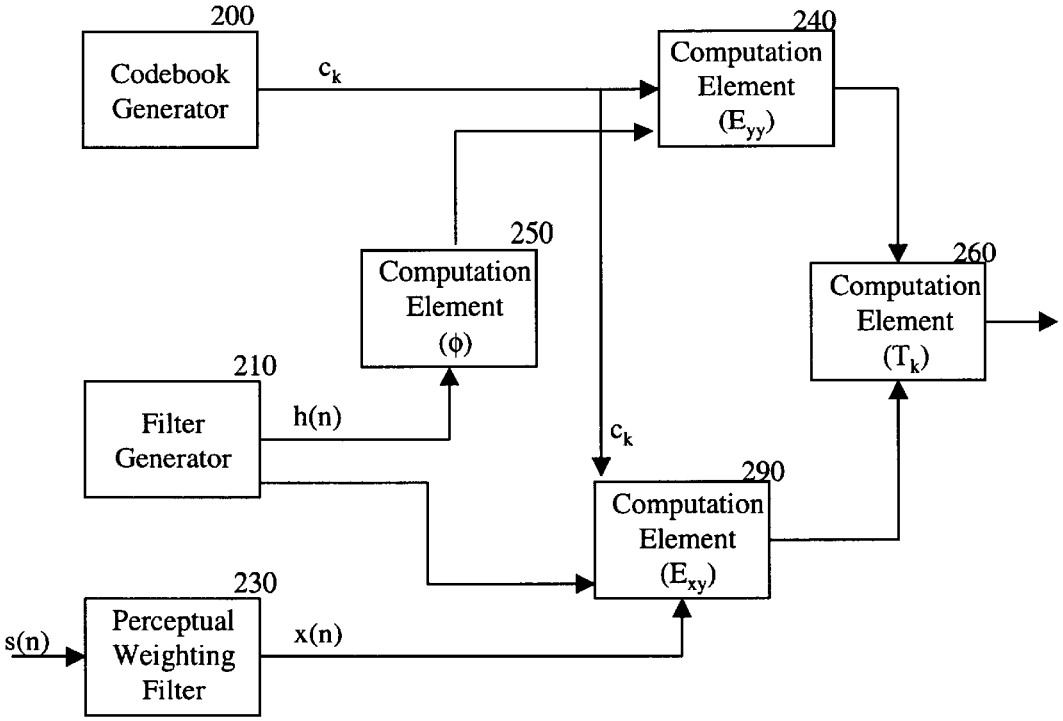
FIG. 2 (Prior Art)
FIG. 2 is a block diagram of a conventional apparatus for performing a codebook search.

FIG. 2 is a block diagram of an apparatus in a conventional encoder for selecting an optimal excitation vector from a codebook. This encoder is designed to minimize the computational complexity involved in searching a waveform codebook by convolving an input signal with the impulse response of a filter, said complexity being further increased by the need to search multiple waveforms in order to determine which waveform results in the closest match to a target signal. The storage requirements for a convolution is M×M, where M is the size of the analysis frame.

A frame of speech samples s(n) is filtered by a perceptual weighting filter 230 to produce a target signal x(n). The design and implementation of perceptual weighting filters is described in aforementioned U.S. Pat. No. 5,414,796. An impulse response generator 210 generates an impulse response h(n). Using the impulse response h(n) and the target signal x(n), a cross-correlation vector d(n) is generated at computation element 290 in accordance with the following relationship:

$$d(i) = \sum_{j=0}^{M-1} x(i)h(i-j), \text{ for } j = 0 \text{ to } M-1.$$

The impulse response h(n) is also used by computation element 250 to generate an autocorrelation matrix:

$$\phi(i, j) = \sum_{n=j}^{M-1} h(n-i)h(n-j), \text{ for } i \geq j$$

The entries of the autocorrelation matrix $\phi$ are sent to computation element 240. Pulse codebook generator 200 generates a plurality of pulse vectors $\{c_k, k=1, \ldots, CB_{size}\}$, which are also input into computation element 240. $CB_{size}$ is the size of the codebook from which an optimal codebook vector is to be chosen. $N_p$ is a value representing the number of pulses in a pulse vector. An excitation waveform codebook, alternatively referred to as a pulse waveform codebook or a pulse codebook herein, can be generated in response to a plurality of pulse position signals, $\{p_k^i, i=0, \ldots, N_p-1\}$ (not shown in figure), wherein $p_k^i$ is the position of the $i^{th}$ unit pulse in the pulse vector, $c_k$. For each pulse, $P_k^i$, a corresponding sign $s_k^i$ is assigned to the pulse. The resulting code vector, $c_k$, is given by the equation below:

$$c_k(j) = \sum_{i=0}^{N_p-1} s_k^i \delta(j - p_k^i), 0 \leq j \leq M-1.$$

Computation element 240 filters the pulse vectors with the autocorrelation matrix $\phi$ in accordance with the following formula:

$$E_{yy} = \sum_{i=0}^{N_p-1} \phi(p_k^i, p_k^i) + 2 \cdot \sum_{i=0}^{N_p-1} \sum_{j=i+1}^{N_p-1} c_k(p_k^i) c_k(p_k^j) \phi(p_k^i, p_k^j).$$

The pulse vectors $\{c_k, k=1, \ldots CB_{size}\}$ are also used by computation element 290 to determine a cross-correlation between d(n) and $c_k(n)$ according to the following equation:

$$E_{xy}^2 = \left( \sum_{i=0}^{N_p-1} c_k(p_k^i) \cdot d(p_k^i) \right)^2.$$

Once values for $E_{yy}$ and $E_{xy}$ are known, a computation element 260 determines the value $T_k$ using the following relationship:

$$T_k = \frac{(E_{xy})^2}{E_{yy}}.$$

The pulse vector that corresponds to the largest value of $T_k$ is selected as the optimum vector to encode the residual waveform.

The embodiments described herein can be used to reduce the storage requirements of the above scheme. Indeed, the embodiments described herein can make any codebook search more computationally efficient. In one embodiment, the number of computations required to choose the optimal codebook vector is reduced by the step of pre-selecting a subset of pulse vectors from the complete codebook, and then performing a search only upon the pre-selected subset. In one embodiment, the pre-selection is determined by the cross-correlation vector d(n). If a pre-selection occurs, then correspondingly, a smaller autocorrelation matrix $\phi$ is used to determine the energy value $E_{yy}$. To one of ordinary skill in the art, the use of a smaller, incomplete autocorrelation matrix $\phi$ may seem undesirable because computationally effective methods using recursions may not be used. Recursions usually rely upon past values in order to compute future values. To deliberately omit certain values in the recursion would lead to an undesirable result.

However, the embodiments herein call for the use of smaller auto-correlation matrixes in order to reduce the memory requirements of a codebook search at the cost of the ability to use recursions in the computations. When the size of the pre-selected subset is small, the gain in memory reduction far outweighs the cost of increasing computational complexity.

Figure 3:
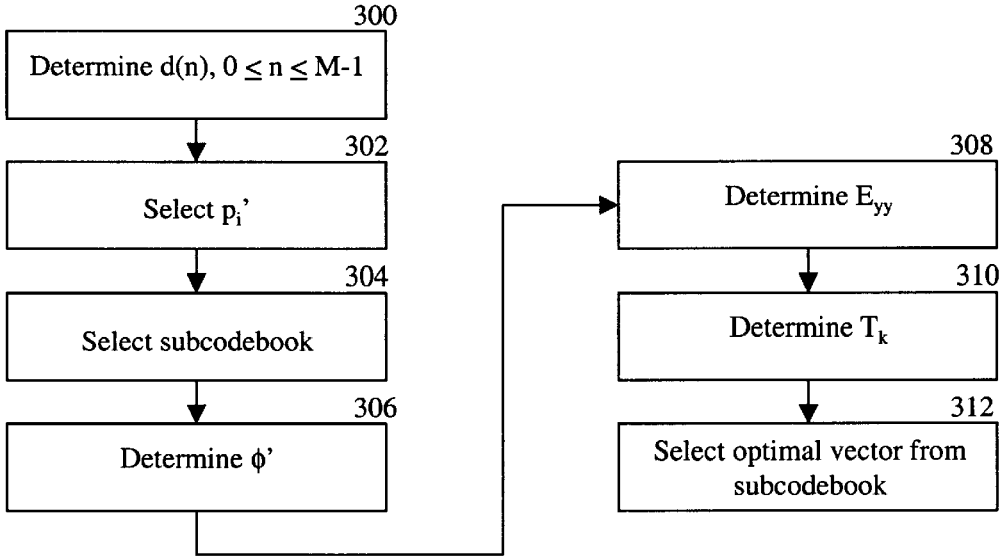
FIG. 3 is a flow chart of method steps to pre-select a subset of pulse vectors from a pulse codebook.

FIG. 3 is a flow chart of an embodiment wherein pre-selection of a subset of pulse vectors from the pulse codebook occurs. At step 300, cross-correlation vector d(n) is determined for $0 \leqq n \leqq M-1$ where M is the dimensionality of the vector, which corresponds to the length of the analysis frame. At step 302, P (such that P<M) positions in the target signal of length M are chosen based on the P highest values of vector d(n), $0 \leqq n \leqq M-1$. For illustrative purposes, the set of these pre-selected pulse positions are denoted by P'. For further notational convenience, let $p'_k{}^i$ be the position of the $i^{th}$ unit pulse in the pulse vector, $c_k$, such that $p'_k{}^i$ belongs to the set P'. Further, let p'(i), $0 \leqq i \leqq P-1$ represent each of the elements of the set P'. For example, in a frame of size M=80, P=20 positions (p'(i), $0 \leqq i \leqq 19$) in the frame can be pre-selected such that d(p'(i)) is within the highest 20 values of d(n), $0 \leqq n \leqq 79$.

At step 304, a plurality of code vectors are chosen from the codebook, based upon whether the code vectors contain pulses only at p'(i), $0 \leqq i \leqq P-1$. At step 306, a sub-matrix $\phi'$ of size P×P is determined, in accordance with the formula:

$$\phi'(i, j) = \sum_{n=\mathrm{MAX}(p'(i),p'(j))}^{M-1} h(n - p'(i))h(n - p'(j)),\ 0 \le i,\ j \le P-1.$$

At step 308, the autocorrelation sub-matrix $\phi'$ is used to determine the energy term, $E_{yy}$ for the pulse vectors in the subcodebook. No energy determination need be performed for the non-selected pulse vectors in the codebook. At step 310, the criterion value $T_k$ is determined for each pulse vector of the subcodebook. At step 312, the pulse vector of the subcodebook corresponding to the largest value for $T_k$ is selected as the optimal pulse vector for encoding the speech signal. The method steps described herein can be interchanged without affecting the scope of the embodiment described herein.

Using the embodiment described above, the storage space required for the codebook vector search is reduced from (M×M) to (P×P). For example, if the analysis frame is 80 samples long, a requirement of 80×80=6400 locations for the analysis frame is reduced to just 20×20=400 when a subcodebook is selected based upon 20 pulse positions. The choice of P is an implementation detail that can vary in accordance with the memory limitations of the coder in which the embodiments are implemented. Hence, the possible value of P can range from anywhere from 1 to M.

Figure 4:
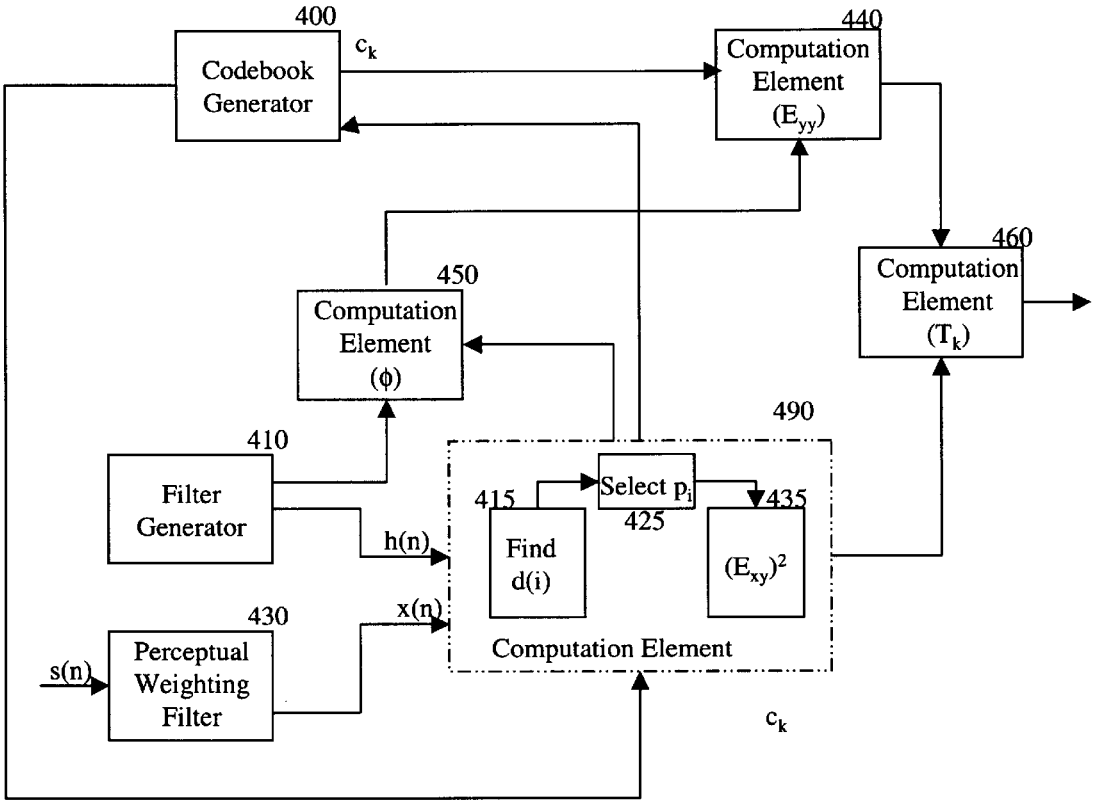
FIG. 4 is a block diagram of an apparatus for performing a codebook search by pre-selecting and searching a subcodebook.

FIG. 4 is an apparatus that is configured to implement a codebook search by pre-selecting and searching a subcodebook. A frame of speech samples s(n) is filtered by a perceptual weighting filter 430 to produce a target signal x(n). An impulse response generator 410 generates an impulse response h(n). Using the impulse response h(n) and the target signal x(n), a cross-correlation vector d(n) is generated at computation element 415 in accordance with the following relationship:

$$d(i) = \sum_{j=1}^{M} x(i)h(i-j), \text{ for } j = 0 \text{ to } M-1.$$

Using pulse vectors generated by pulse codebook generator 400, selection element 425 determines the pulse positions p'(i), $0 \leqq i \leqq P-1$for which d(p'(i)) has the P largest values of d(n). The pulse positions p'(i) are used by computation element 435 to determine the cross-correlation value $(E_{xy}')^2$, in accordance with the following formula:

$$(E'_{xy})^2 = \left( \sum_{i=0}^{P-1} c_k(p_k'^i) \cdot d(p_k'^i) \right)^2.$$

It should be noted that the number of pulses is still $N_p$, but the pulse positions take values only from the set P'.

In one embodiment, a cross-correlation element 490 is configured to implement the functions of computation elements 415, 435 and the selection element 425. In another embodiment, the apparatus could be configured so that the function of the selection element 425 is performed by a component that is separate from a component performing the functions of the computation elements 415, 435. It is possible to have many configurations of components within the apparatus without affecting the scope of the embodiments described herein.

The pulse positions p'(i) are further used by computation element 450 to determine an autocorrelation sub-matrix $\phi'$ of dimensionality P×P, and by a pulse codebook generator 400 to determine the search parameters for the subcodebook.

Computation element 450 uses the pulse positions p'(i)' and the impulse response h(n) to generate an autocorrelation sub-matrix $\phi'$ in accordance with the formula:

$$\phi'(p'(i), p'(j)) = \sum_{n=\mathrm{MAX}(p'(i),p'(j))}^{M-1} h(n-p'(i))h(n-p'(j)),\ 0 \le i, j \le P-1.$$

The entries of the autocorrelation sub-matrix $\phi'$ are sent to computation element 440.

A pulse subcodebook is generated by pulse codebook generator 400 in response to a plurality of pulse position signals, $\{p'_k{}^i, i=0, \ldots N_p-1\}$, from selection element 425, wherein $P'_k{}^i$ is the position of the $i^{th}$ unit pulse in the pulse vector, $c_k$, such that $p'_k{}^i$ is an element of the set P'. $N_p$ is a value representing the number of pulses in a pulse vector. Pulse codebook generator 400 generates a plurality of pulse vectors $\{c_k, k=1, \ldots, CB1_{size}\}$ where $CB1_{size}$ is less than $CB_{size}$ as a result of pre-selection.

Computation element 440 filters the pulse vectors with the autocorrelation sub-matrix $\phi'$ in accordance with the following formula:

$$E_{yy} = \sum_{i=0}^{N_p-1} \phi'(p_k'^i, p_k'^i) + 2 \cdot \sum_{i=0}^{N_p-1} \sum_{j=i+1}^{N_p-1} c_k(p_k'^i) c_k(p_k'^j) \phi'(p_k'^i, p_k'^j).$$

The pulse vectors $\{c_k, k=1, \ldots, CB1_{size}\}$ are also used by computation element 490 to determine a cross-correlation between d(n) and $c_k(n)$ as stated above.

Once values for $E_{yy}$ and $E_{xy}$ are known, a computation element 460 determines the value $T_k$ using the following relationship:

$$T_k = \frac{(E_{xy})^2}{E_{yy}}.$$

The pulse vector that corresponds to the largest value of $T_k$ is selected as the optimum vector to encode the residual waveform. In one embodiment, during the search for the optimal codebook vector, the pulse positions are not indexed through all the positions in the frame. Rather, the pulse positions are indexed through just the pre-selected positions.

In another embodiment, a single processor and memory can be configured to perform all functions of the individual components of FIG. 4.

Reducing Storage Requirements of a Coder That Uses Pitch Enhancements

In the new generation of coders, such as the Enhanced Variable Rate Codec (EVRC) and the Selectable Mode Vocoder (SMV), the pitch periodicity contribution of the codebook pulses is enhanced by incorporating a gain-adjusted forward and backward pitch sharpening process into the analysis frame of the speech signal.

An example of pitch sharpening is the formation of a composite impulse response $\tilde{h}(n)$ from h(n) in accordance with the following relationship:

$$\tilde{h}(n) = g_p^{P-1} h(n-(P-1)L) + \ldots + g_p^3 h(n-3L) + g_p^2 h(n-2L) + g_p h(n+L) + g_p h(n+L) + g_p^2 h(n+2L) + g_p^3 h(n+3L) + \ldots + g_p^{P-1} h(n+(P-1)L)$$

in which P is the number of pitch lag periods (whole or partial) of length L contained in the subframe, L is the pitch lag, and $g_p$ is the pitch gain.

Figure 5:
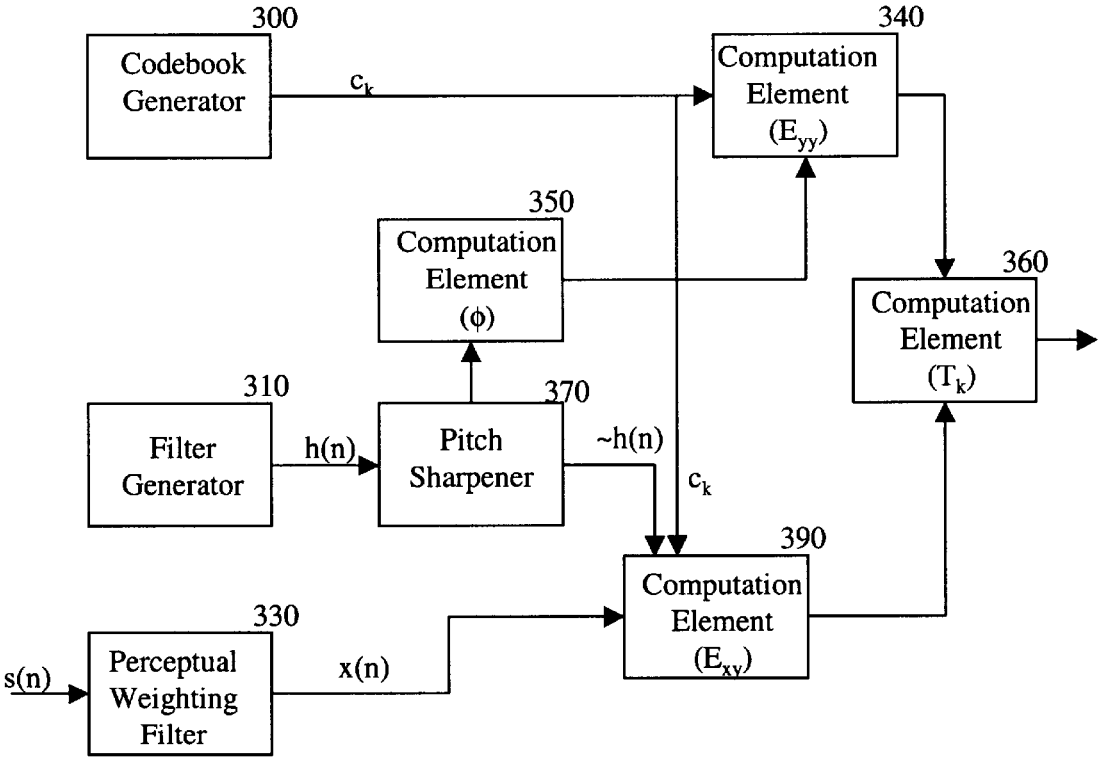
FIG. 5 (Prior Art)
FIG. 5 is a block diagram of an apparatus for performing a codebook search in a coder that uses pitch-enhanced impulse responses.

FIG. 5 is a block diagram of an apparatus for searching an excitation codebook in which the impulse response of the filter has been pitch enhanced. A frame of speech samples s(n) is filtered by a perceptual weighting filter 530 to produce a target signal x(n). An impulse response generator 510 generates an impulse response h(n). The impulse response h(n) is input into a pitch sharpener element 570 and yields a composite impulse response $\tilde{h}(n)$. The composite impulse response $\tilde{h}(n)$ and the target signal x(n) are input into a computation element 590 to determine a cross-correlation vector d(n) in accordance with the following relationship:

$$d(i) = \sum_{j=0}^{M-1} x(i)\tilde{h}(i-j), \text{ for } j = 0 \text{ to } M-1.$$

The composite impulse response $\tilde{h}(n)$ is also used by computation element 550 to generate an autocorrelation matrix:

$$\phi(i, j) = \sum_{n=j}^{M-1} \tilde{h}(n-i)\tilde{h}(n-j), \text{ for } i \ge j.$$

The entries of the autocorrelation matrix $\phi$ are sent to computation element 540. Pulse codebook generator 500 generates a plurality of pulse vectors $\{c_k, k=1, \ldots CB_{size}\}$, which are also input into computation element 540. $CB_{size}$ is the size of the codebook from which an optimal codebook vector is to be chosen. $N_p$ is a value representing the number of pulses in a pulse vector. Computation element 540 filters the pulse vectors with the autocorrelation matrix in accordance with the formula:

$$E_{yy} = \sum_{i=0}^{N_p-1} \phi(p_k^i, p_k^i) + 2 \cdot \sum_{i=0}^{N_p-1} \sum_{j=i+1}^{N_p-1} c_k(p_k^i) c_k(p_k^j) \phi(p_k^i, p_k^j)$$

The pulse vectors $\{c_k, k=1, \ldots, CB_{size}\}$ are also used by computation element 590 to determine a cross-correlation between d(n) and $c_k(n)$ according to the following equation:

$$E_{xy}^2 = \left( \sum_{i=0}^{N_p-1} c_k(p_k^i) \cdot d(p_k^i) \right)^2.$$

Once values for $E_{yy}$ and $E_{xy}$ are known, a computation element 560 determines the value $T_k$ using the following relationship:

$$T_k = \frac{(E_{xy})^2}{E_{yy}}.$$

The pulse vector that corresponds to the largest value of $T_k$ is selected as the optimum vector to encode the residual waveform.

Figure 6:
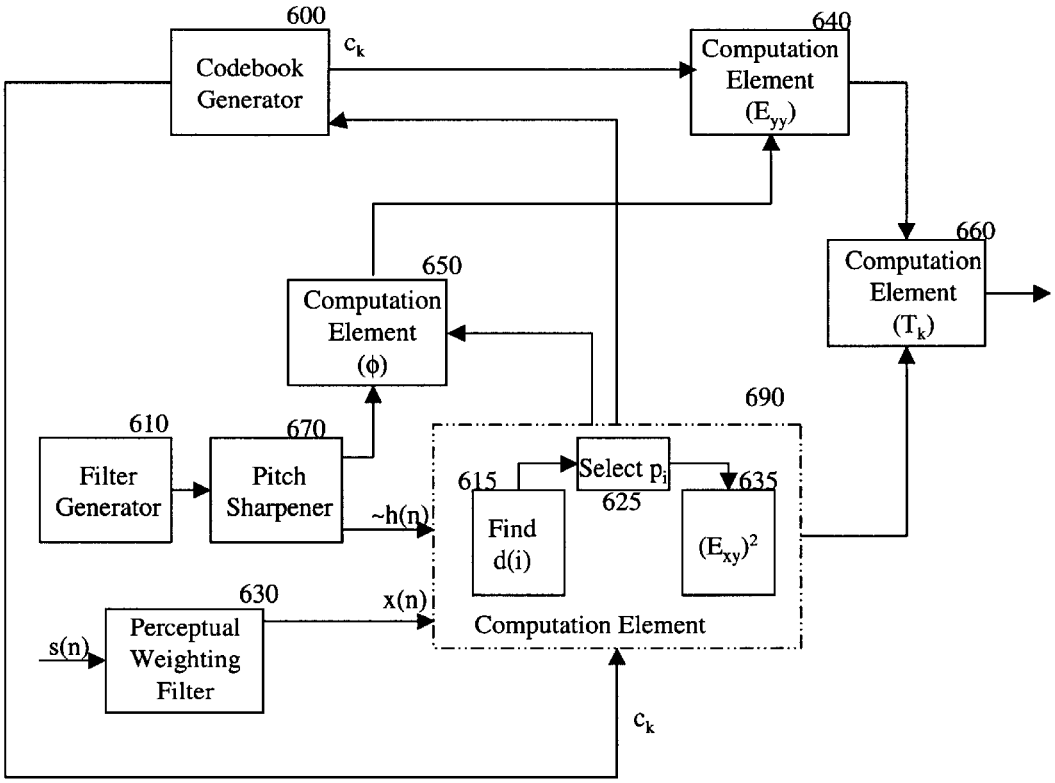
FIG. 6 is a block diagram of an apparatus for performing a codebook search in a coder that uses pitch-enhanced impulse responses by pre-selecting and searching a subcodebook.

FIG. 6 is a block diagram of an apparatus that will perform a fast codebook search of a coder that incorporates pitch enhancements in the impulse response. A frame of speech samples s(n) is filtered by a perceptual weighting filter 630 to produce a target signal x(n). An impulse response generator 610 generates an impulse response h(n). The impulse response h(n) is input into a pitch sharpener element 670 and yields a composite impulse response $\tilde{h}(n)$. The composite impulse response $\tilde{h}(n)$ and the target signal x(n) are input into a computation element 615 to determine a cross-correlation vector d(n) in accordance with the following relationship:

$$d(i) = \sum_{j=0}^{M-1} x(i)\tilde{h}(i-j), \text{ for } j = 0 \text{ to } M-1.$$

Using pulse vectors generated by pulse codebook generator 600, selection element 625 determines the pulse positions p'(i), $0 \leqq i \leqq P-1$, for which d(p'(i)) has the P largest values of d(n). The pulse positions p'(i) are used by computation element 635 to determine the cross-correlation value $(E_{xy}')^2$, in accordance with the following formula:

$$(E'_{xy})^2 = \left(\sum_{i=0}^{P-1} c_k(p'^i_k)\cdot d(p'^i_k)\right)^2.$$

In one embodiment, a cross-correlation element 690 is configured to implement the functions of computation elements 615, 635 and the selection element 625. In another embodiment, the apparatus could be configured so that the function of the selection element 625 is performed by a component that is separate from a component performing the functions of the computation elements 615, 635. It is possible to have many configurations of components within the apparatus without affecting the scope of the embodiments described herein.

The pulse positions p'(i) are further used by computation element 650 to determine an autocorrelation sub-matrix φ' of dimensionality P×P, and by pulse codebook generator 600 to determine the search parameters for the subcodebook. Computation element 650 uses the pulse positions p'(i) and the composite impulse response $\tilde{h}(n)$ to generate an autocorrelation sub-matrixφ' in accordance with the formula:

$$\phi'(p'(i), p'(j)) = \sum_{n=\mathrm{MAX}(p'(i),p'(j))}^{M-1} h(n-p'(i))h(n-p'(j)),\ 0 \le i,\ j \le P-1.$$

The entries of the autocorrelation sub-matrix φ' are sent to computation element 640.

A pulse subcodebook is generated by pulse codebook generator 600 in response to a plurality of pulse position signals $\{p'^i_k, i=0, \ldots, N_p-1\}$ from selection element 425, wherein $p'^i_k$ is the position of the $i^{th}$ unit pulse in the pulse vector, $c_k$, such that $p'^i_k$ is an element of the set P'. $N_p$ is a value representing the number of pulses in a pulse vector. Pulse codebook generator 600 generates a plurality of pulse vectors $\{c_k, k=1, \ldots, CB1_{size}\}$.

Computation element 640 filters the pulse vectors with the autocorrelation sub-matrix φ' in accordance with the following formula:

$$E_{yy} = \sum_{i=0}^{N_p-1} \phi'(p'^i_k, p'^i_k) + 2\cdot \sum_{i=0}^{N_p-1}\sum_{j=i+1}^{N_p-1} c_k(p'^i_k)c_k(p'^j_k)\phi'(p'^i_k, p'^j_k).$$

The pulse vectors $\{c_k, k=1, \ldots, CB1_{size}\}$ are also used by computation element 635 to determine a cross-correlation $E_{yy}$ between d(n) and $c_k(n)$ as stated above.

Once values for $E_{yy}$ and $E_{xy}$ are known, a computation element 660 determines the value $T_k$ using the following relationship:

$$T_k = \frac{(E_{xy})^2}{E_{yy}}.$$

The pulse vector that corresponds to the largest value of $T_k$ is selected as the optimum vector to encode the residual waveform. The above computation of $E_{yy}$ has the advantage of incorporating the forward and backward pitch sharpening into the codebook search without the need for a memory intensive computation. Hence, the embodiments convert an existing requirement for M×M storage spaces into a requirement for only P×P storage spaces.

Reducing the Complexity of a 2-Pulse Codebook Search

In yet another embodiment, the complexity of a 2-pulse ($N_p$=2) search is reduced by pre-computing an $E_{yy}$ matrix, rather than an autocorrelation matrix φ. This embodiment is described in relation to the embodiments described above for FIG. 6, but it should be noted that this embodiment could be implemented alone without undue experimentation. For illustrative purposes only, the notation in the description of FIG. 6 is used.

Figure 7:
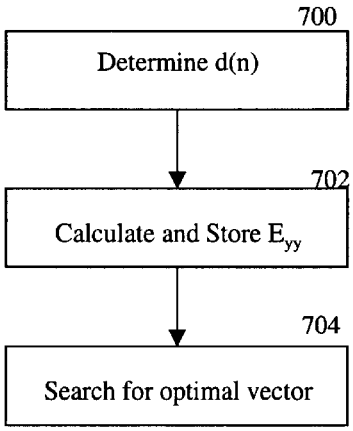
FIG. 7 is a flow chart of method steps for performing a fast codebook search by using a lookup table.

FIG. 7 is a flow chart illustrating the use of a memory lookup table to determine the optimal code vector, rather than an intensive computation. At step 700, the cross-correlation vector d(n) is determined using the impulse response h(n) of the LPC filter and the target signal x(n). At step 702, an energy vector $E_{yy}$ is determined in accordance with the following formula:

$$E_{yy}(p'(i),p'(j))=\phi'(p'(i),i)+\phi'(p'(j),p'(j))+2c(p'(i))c(p'(i))\phi'(p'(i),p'(j)),$$

where $0 \leqq i, j \leqq P-1$ and φ'(i,j) values are computed according to the equation:

$$\phi'(p'(i), p'(j)) = \sum_{n=\mathrm{MAX}(p'(i),p'(j))}^{M-1} h(n-p'(i))h(n-p'(j)),\ 0 \le i,\ j \le P-1.$$

Hence, rather than computing the entire matrix φ', specific entries of the matrix φ' are computed and used to generate the matrix $E_{yy}$. At step 704, a search for an optimal code vector is performed using a lookup table storing the values $E_{yy}(i,j)$. Using a lookup table with stored $E_{yy}$ values allows a reduction in the complexity of the search because the system no longer needs to sum many values of matrix φ to determine the $E_{yy}$ value for each pulse vector being searched in the codebook.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus for selecting an optimal pulse vector from a pulse vector codebook, wherein the optimal pulse vector is used by a linear prediction coder to encode a residual waveform, the apparatus comprising:

an impulse response generator for generating an impulse response vector;

a cross-correlation element configured to determine a cross-correlation vector relating the impulse response vector to a plurality of target signal samples from a filter, wherein the cross-correlation vector is used to determine a plurality of pulse positions such that the insertion of the plurality of pulse positions into the cross-correlation vector provides a predetermined number of high cross-correlation values;

a pulse codebook generator configured to receive an indication signal indicative of the plurality of pulse positions from the cross-correlation element, and to output a plurality of pulse vectors in response to the indication signal, wherein the plurality of pulse vectors is a subset of the pulse vector codebook; and an energy computation element for determining an autocorrelation sub-matrix based upon the subset of the pulse vector codebook, wherein the autocorrelation sub-matrix and the cross-correlation vector are used to select the optimal pulse vector from the codebook.

2. The apparatus of claim 1, wherein the cross-correlation element comprises:

at least one computation element for determining the cross-correlation vector; and a selection element for determining the plurality of pulse positions and for generating the indication signal.

3. An apparatus for reducing the memory requirements of a codebook search, comprising:

an impulse response generator for generating an impulse response signal;

a cross-correlation element configured to determine a cross-correlation vector relating the impulse response signal to a target signal;

a selection element configured to receive the cross-correlation vector, to use the cross-correlation vector to identify an optimal set of pulse positions, and to generate an indication signal that carries the identification of the optimal set of pulse positions;

a pulse codebook generator that is configured to receive the indication signal from the selection element and to generate a plurality of pulse vectors, wherein the plurality of pulse vectors are generated based upon the identification of the optimal set of pulse positions carried by indication signal; and an energy computation element for determining an autocorrelation sub-matrix based on to plurality of pulse vectors, wherein the autocorrelation sub-matrix is used instead of an autocorrelation matrix, thereby decreasing the memory requirement of to codebook search.

4. An apparatus for selecting a best-fit pulse vector from among a plurality of pulse vectors for encoding a residual waveform, the apparatus comprising:

a memory element; and a processing element coupled to the memory element and configured to implement a set of instructions stored in the memory element, to set of instructions:

determining an optimal set of pulse positions based upon a predetermined cross-correlation vector;

determining a plurality of pulse vectors that correspond with the optimal set of pulse positions, wherein the plurality of pulse vectors is less than the codebook;

calculating an autocorrelation sub-matrix based only upon the plurality of pulse vectors;

using the autocorrelation sub-matrix to determine a plurality of energy values, wherein each energy value corresponds to one of the plurality of pulse vectors; and selecting the best-fit pulse vector as the pulse vector from the plurality of pulse vectors with a highest criterion value, wherein the highest criterion value is determined in accordance with the plurality of energy values and the cross-correlation vector.

* * * * *